US010214031B2

(12) United States Patent
Ito

(10) Patent No.: US 10,214,031 B2
(45) Date of Patent: Feb. 26, 2019

(54) INKJET PRINT APPARATUS AND RECOVERY METHOD OF INKJET PRINT APPARATUS

(71) Applicant: CANON FINETECH NISCA INC., Misato-shi (JP)

(72) Inventor: Hideyuki Ito, Tsukubamirai (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/902,194

(22) Filed: Feb. 22, 2018

(65) Prior Publication Data

US 2018/0244048 A1 Aug. 30, 2018

(30) Foreign Application Priority Data

Feb. 24, 2017 (JP) ..... 2017-033686
Feb. 9, 2018 (JP) ..... 2018-022186

(51) Int. Cl.
*B41J 11/00* (2006.01)
*B41J 13/00* (2006.01)
*B41J 2/165* (2006.01)

(52) U.S. Cl.
CPC ..... *B41J 11/0085* (2013.01); *B41J 2/165* (2013.01); *B41J 11/0095* (2013.01); *B41J 13/0027* (2013.01); *B41J 2002/16573* (2013.01)

(58) Field of Classification Search
CPC .... B41J 11/0085; B41J 13/0027; B41J 2/165; B41J 2002/16573
See application file for complete search history.

(56) References Cited

U.S. PATENT DOCUMENTS

2007/0222814 A1 9/2007 Ito
2009/0179928 A1 7/2009 Nemoto

FOREIGN PATENT DOCUMENTS

EP 0803359 A2 10/1997
EP 0972642 A1 1/2000
JP 2004-160803 A 6/2004

OTHER PUBLICATIONS

Partial European Search Report issued in corresponding European Application No. 18158309 dated Jul. 24, 2018.

*Primary Examiner* — Julian D Huffman
(74) *Attorney, Agent, or Firm* — Venable LLP

(57) ABSTRACT

The invention provides an inkjet print apparatus and a recovery method of an inkjet print apparatus, which can suppress deterioration of productivity. For that purpose, timing, at which a recovery operation is practiced in accordance with a facing time period of a print head and a print medium and a not facing time period thereof, is set.

14 Claims, 9 Drawing Sheets

$$\text{ALLOWABLE EXPOSURE TIME PERIOD (s)} = 51\text{s} \times \frac{\frac{55\text{mm}}{160\text{mm/s}}}{0.42\text{s}} = 41\text{s}$$

| SETTING OF CONVEYING INTERVAL | RECOVERY MODE (ALLOWABLE EXPOSURE TIME PERIOD) |
|---|---|
| STANDARD | STANDARD (50 SECONDS) |
| LONG | SHORT (40 SECONDS) |

| SETTING OF PRELIMINARY EJECTION TO SHEET SURFACE | LEVEL1 | LEVEL2 | LEVEL3 |
|---|---|---|---|
| COEFFICIENT OF ALLOWABLE EXPOSURE TIME PERIOD | 1.2 | 1.4 | 1.6 |

INKJET PRINT APPARATUS AND RECOVERY METHOD OF INKJET PRINT APPARATUS

BACKGROUND OF THE INVENTION

Field of the Invention

The present invention relates to an inkjet print apparatus for ejecting ink to a print medium to be conveyed to implement print, and to a recovery method of an inkjet print apparatus.

Description of the Related Art

A kind of ink for use in print uses water as a solvent, and in a case where the ink is exposed to the air, water being a solvent evaporates to generate viscosity rising (increase in viscosity) of the ink. In a case where the increase in viscosity of an ink in an ejection port of a print head occurs, decrease in an ejection quantity and/or an ejection velocity in the print operation occurs to degrade image quality. Consequently, for conventional inkjet print apparatuses, a capping mechanism that covers the ejection port is provided, which covers the ejection port when print is stopped to prevent the ink in the ejection port from increasing the viscosity. Further, there is implemented an ink discharge processing (preliminary ejection) for discharging an ink whose viscosity has increased and/or an ink in which dust has been mixed up from the ejection port to the capping mechanism. During the implementation of the preliminary ejection, print onto a print medium cannot be implemented. Therefore, the increase of the number of the preliminary ejections deteriorates productivity, and thus the preliminary ejection is preferably kept to a minimum.

However, although the degree of increase in viscosity of an ink in an ejection port varies depending on working states of an apparatus, the preliminary ejection is practiced uniformly, and thus deterioration of productivity is comprehended.

Then, Japanese Patent Laid-Open No. 2004-160803 proposes to implement the preliminary ejection in accordance with a time period during which an ejection port is exposed to the air.

However, even in a state where an ejection port is exposed to the air, there are a state where an ink in the ejection port is easy to evaporate and a state where the ink is hard to evaporate. Therefore, even if the preliminary ejection is implemented in accordance with a time period during which an ejection port is exposed to the air, as in Japanese Patent Laid-Open No. 2004-160803, deterioration of productivity is still comprehended.

SUMMARY OF THE INVENTION

The inkjet print apparatus of the present invention includes a print unit configured to eject ink to a print medium to implement print, a recovery unit configured to practice recovery processing to recover an ejection performance for ink of the print unit, and a setting unit configured to set timing at which the recovery unit practices the recovery processing on a basis of a facing time period during which the print unit faces a print medium in a print operation and a not facing time period during which the print unit does not face the print medium in the print operation.

Further features of the present invention will become apparent from the following description of exemplary embodiments with reference to the attached drawings.

DESCRIPTION OF THE EMBODIMENTS

First Embodiment

Hereinafter, a first embodiment of the present invention will be explained with reference to the drawings.

Figure 1:
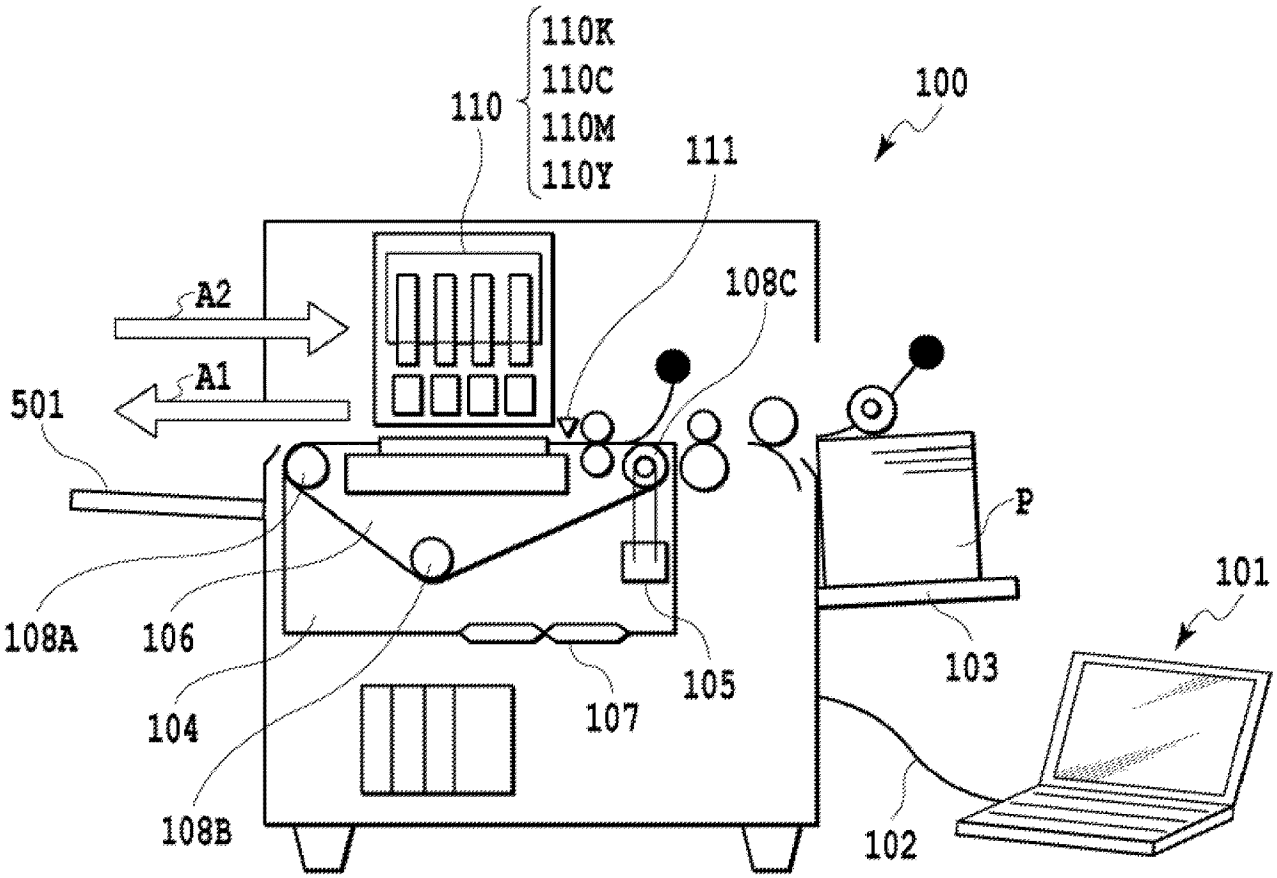
FIG. 1 illustrates a print system in which a card printer is connected with a host computer.

FIG. 1 illustrates a print system in which an inkjet type card printer (hereinafter, also called a print apparatus) 100 of the present embodiment is connected with a host computer (hereinafter, also called a host) 101. The print apparatus 100 is connected to the host computer 101 as an information processor by a printer cable 102. The host 101 outputs information about image data and print medium, etc. as control commands to the print apparatus 100 via the printer cable 102. A plurality of print medium P are mounted on a feeding tray 103, and are fed in turn from a print medium lying uppermost position to be printed by a print head 110. A conveying unit 104 conveying the print medium includes a conveying motor 105, a conveying belt 106 and a suction fan (negative pressure generator) 107.

The conveying belt 106 is bridged between guide rollers 108A, 108B and a drive roller 108C. As a result that the drive roller 108C is rotated by the conveying motor 105, the conveying belt 106 supporting the print medium P moves to an arrow Al direction. Rotation of the suction fan 107 generates negative pressure, and air is sucked from suction holes (not illustrated) formed in the conveying belt 106 in plural numbers to be discharged from an exhaust port of the conveying unit 104. The conveying belt 106 attaches the print medium P to the surface of the conveying belt 106 by suction of air from the suction hole, and, in that state, conveys the print medium P along the arrow A1 direction (first direction).

The print apparatus 100 includes a print unit, and, on the print unit, the print head 110 of an inkjet type capable of printing an image to a print medium is mounted detachably. The print head 110 ejects ink, using an ejection energy-generating element such as an electro-thermal conversion element (heater), a piezoelectric element or the like. In a case where an electro-thermal conversion element is used, ink is caused to foam by heat generation of the element, and the foaming energy thereof is utilized to eject ink from an ejection port formed for the print head 110. A plurality of ejection ports in the print head 110 is arranged so as to form at least one ejection port row extending in a direction orthogonal to the conveying direction of the print medium P. The print head 110 in the present embodiment is an inkjet print head of a full line type, in which an ejection port row with length corresponding to the largest width of the print region of the print medium P is formed.

For the print unit, a capping mechanism, which receives ink having been ejected in preliminary ejection ejecting an ink not contributing print prior to a print operation, is provided in accordance with the print head 110. For the print apparatus 100, a front end detection sensor 111 is provided, which detects the front end of the print medium P in order to obtain print timing. The front end detection sensor 111 has a configuration provided with either one of or both of a reflection type sensor and a transmission type sensor. For example, in a case where a print medium is a label, the front end of the label as a unit print region is detected by the difference between transmittance of a sheet (separator) to which the label has been stuck and transmittance of the label stuck to the separator. For the rotation shaft of the guide roller 108A, an encoder (not illustrated) rotating in synchronization with the rotation shaft is provided, which functions as a detector detecting a conveying position of the print medium P. The conveyance of the print medium P by the conveying unit 104 and the print timing by the print head 110 are managed by a CPU to be described later on the basis of the detection signal of the encoder. The print medium P having been printed is discharged to a discharge tray 501.

Figure 2:
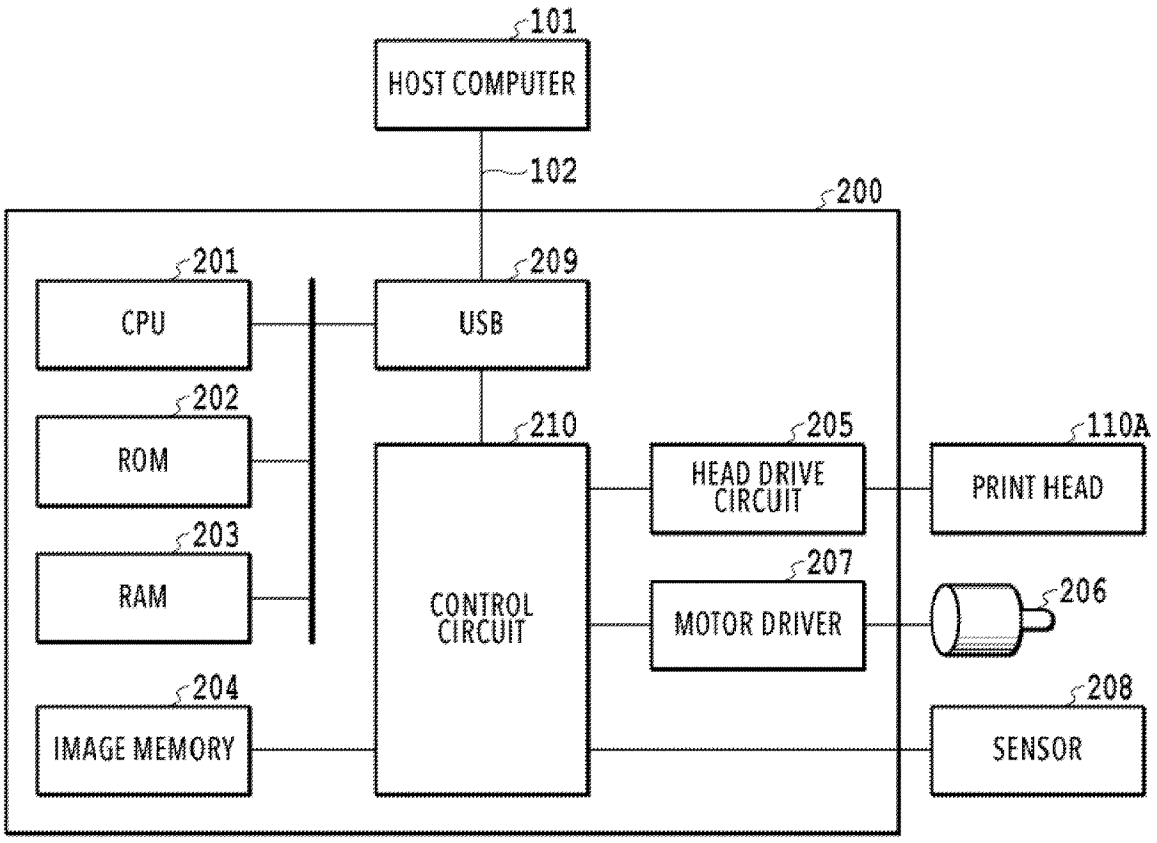
FIG. 2 illustrates a block diagram showing a configuration example of control hardware of a print apparatus.

FIG. 2 illustrates a block diagram showing a configuration example of control hardware of the print apparatus 100 according to the present embodiment. A control unit 200 of the print apparatus 100 includes a central processing unit (CPU) 201 and executes control programs stored in a nonvolatile memory (ROM) 202 to control each of constituent components of the print apparatus 100. In addition, the control unit 200 includes a memory (RAM) 203 used as a work area of various data processing and/or a receive buffer, and an image memory 204 as an image decompression unit.

A control circuit 210 of the control unit 200 includes a drive circuit 205 driving the print head 110, a motor driver 207, a sensor 208 and the like. The motor driver 207 is a driver for various motors 206 controlling a cleaning operation and print operation of the print head. The sensor 208 is used for control of various operations, detection of presence/absence of the print medium P, and the like in the print apparatus 100. The control unit 200 is connected with the host 101 via a USB 209.

Print commands to be sent to the print apparatus 100 from the host 101 in the present embodiment via the printer cable 102 will be explained. The print commands include a print medium setting command telling a size of the print medium P and the like, a format command designating a print area and the like, a conveying speed setting command designating a conveying speed of the print medium P, and a data command telling image data of a print image.

In a print image color command, number of print image colors is stored, and, in accordance with the number of print image color, one or more data are stored in image data command. In a case where print image color is K (black) alone, one image data is stored. In a case where print image color includes K (black), C (cyan), M (magenta) and Y (yellow), four image data are stored in order.

Figure 3:
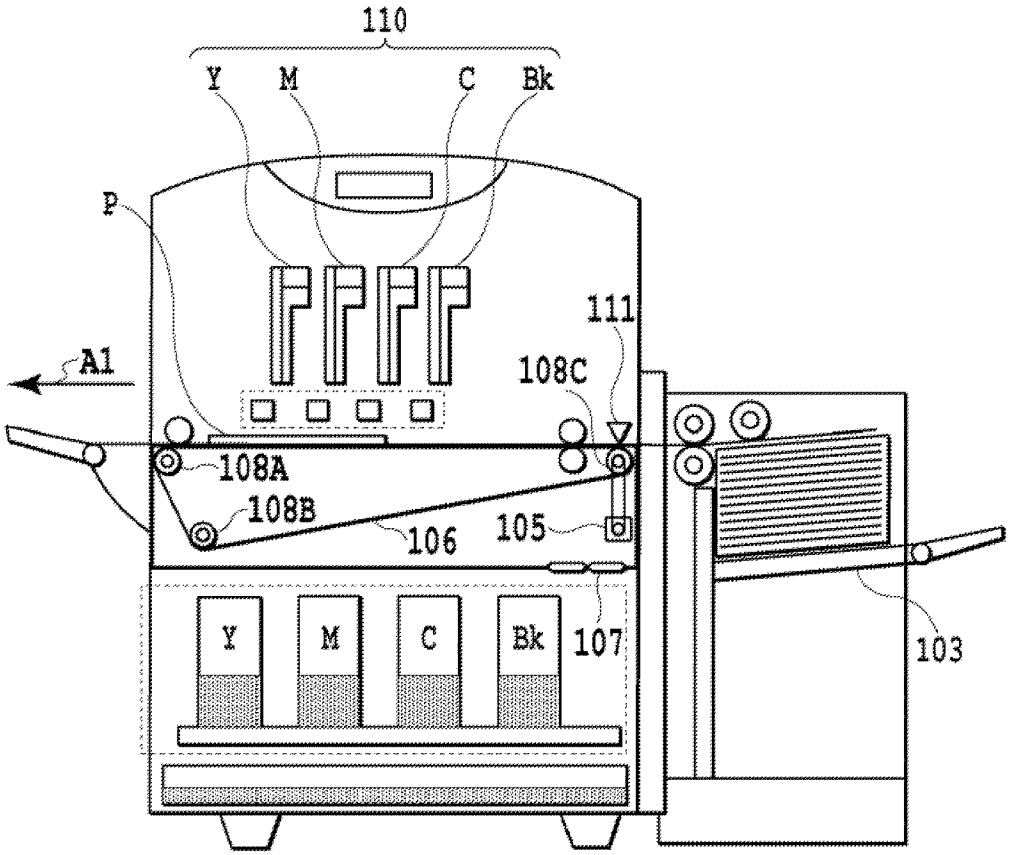
FIG. 3 illustrates a side view showing the print apparatus in print operation.

FIG. 3 illustrates a side view showing the print apparatus 100 in a print operation. Hereinafter, print operations in the inkjet print apparatus 100 will be explained. The print medium P to be printed is conveyed, loaded on the conveying belt 106 and, on the conveying belt 106, is attached to the conveying belt 106 by a suction force of the suction fan 107. The print medium P is conveyed at predetermined intervals on the conveying belt 106, and after the front end thereof passes under the front end detection sensor 111 to be detected, a conveying position of the print medium P is detected with an encoder (not illustrated) rotating in synchronization with the rotation shaft of the guide roller 108A. In the print operation, while a print medium is conveyed in the arrow A1 direction, ink is given from the print unit 110 to implement print on the print medium.

Figure 4A:
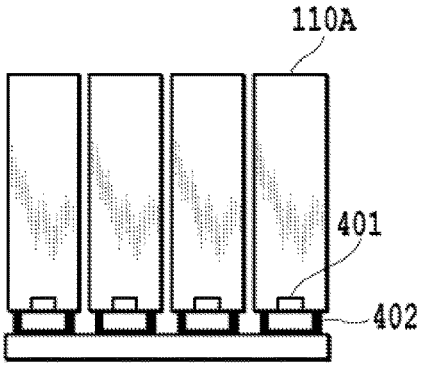
FIG. 4A illustrates a capping operation by a print head and a capping mechanism.
Figure 4B:
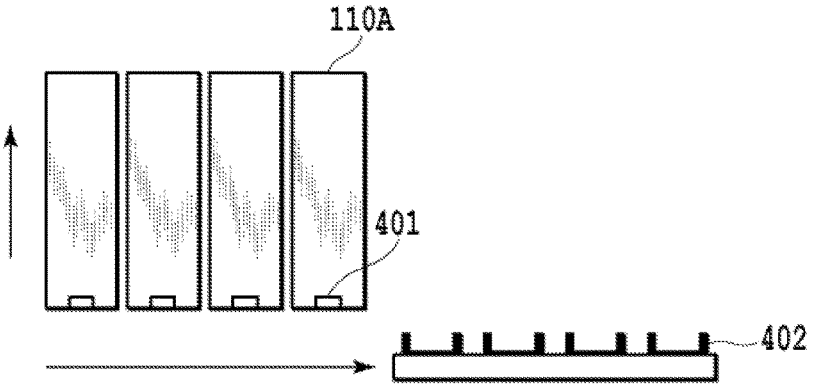
FIG. 4B illustrates the capping operation by the print head and the capping mechanism.
Figure 4C:
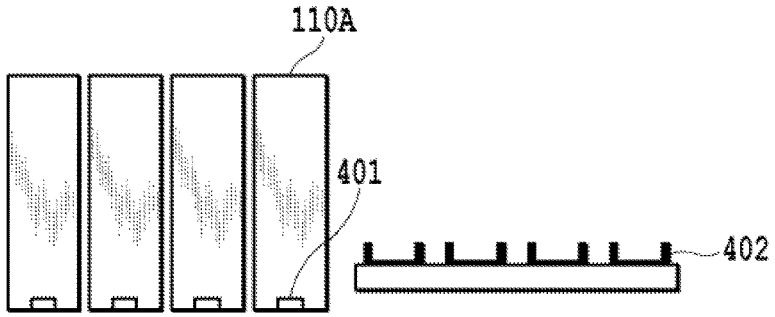
FIG. 4C illustrates the capping operation by the print head and the capping mechanism.

FIGS. 4A to 4C illustrate a capping operation by the print head 110 and a capping mechanism 402. An ejection port surface for which an ejection port 401 of the print head 110 is provided is covered with the capping mechanism 402 as in FIG. 4A in order to prevent evaporation of moisture from an ink in the ejection port in waiting time of print. However, in a print operation, since the ink is ejected from the ejection port 401 to the print medium, the print head 110 is separated from the capping mechanism 402 and the capping mechanism 402 retreats as in FIG. 4B. After that, as in FIG. 4C, the print head 110 descends to a print position and implements a print operation. In this way, during the separation of the capping mechanism 402 from the print head 110, the ejection port is exposed to the air and moisture evaporates from the ink in the ejection port.

Figure 5A:
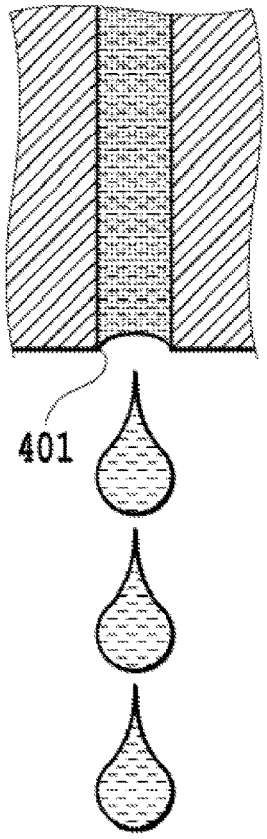
FIG. 5A illustrates an ejection port of the print head and ink ejected from the ejection port.
Figure 5B:
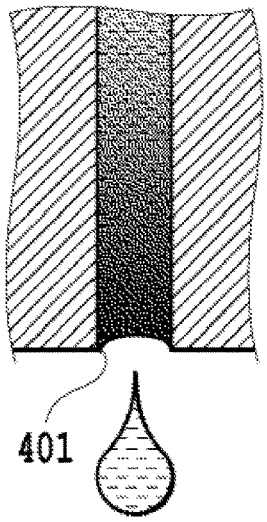
FIG. 5B illustrates the ejection port of the print head and the ink ejected from the ejection port.

FIGS. 5A and 5B illustrate the ejection port 401 of the print head 110 and the ink ejected from the ejection port 401. In a state where a predetermined quantity of ink is ejected in the print operation, an ink in the ejection port from which moisture has evaporated by exposure to the air can be discharged by the ejection (see FIG. 5A). However, in a case where a discharge quantity of ink in a print operation is small (discharge rate is low), an ink from which moisture has evaporated cannot be ejected sufficiently and, as in FIG. 5B, increase in viscosity of an ink near the ejection port progresses. Then, in a case where a discharge quantity of ink in a print operation is small, a preliminary ejection in which ink that does not contribute to print is ejected is implemented at regular intervals so as to discharge an ink from which moisture has evaporated from the ejection port to be refreshed and thereby keep the ejection performance in a good condition. Such a preliminary ejection is practiced as one for the capping mechanism 402, one within an image formation region on a sheet surface so as not to be easily seen visually, one outside an image formation region on a print medium, or in a combination thereof, as a recovery operation (recovery processing) keeping ejection performance in a good condition.

Further, it has been explained that moisture evaporates from the ink in the ejection port in a state where the ejection port of the print head 110 is not covered with the capping mechanism 402. However, even in the state where the ejection port is not covered with the capping mechanism 402, there are a state where moisture is easy to evaporate and a state where moisture is hard to evaporate. Hereinafter, the state where moisture is easy to evaporate and the state where moisture is hard to evaporate, from the ink in the ejection port, will be explained.

As explained in FIGS. 1 and 3, the print medium is loaded on the conveying belt 106 and conveyed. On this occasion, the print medium is attached to the conveying belt 106 by a suction force of the suction fan 107 provided in a lower portion of the conveying belt 106. Further, the print medium is conveyed with a predetermined space on the conveying belt 106. Between conveyed print medium, a print medium is absent and, therefore, a flow of air from the upper surface of the conveying belt 106 (surface for loading print medium) toward the lower surface thereof is generated due to the suction of air from suction holes by the suction fan 107.

During the print operation, the print head 110 is arranged so that the ejection port faces the print medium. In an interval after the print head 110 has completed print to a print medium until the ejection port faces a subsequent print medium, a region in which a print medium is absent (the ejection port does not face a print medium) exists between the print medium and the subsequent print medium. In the region in which the ejection port does not face a print medium, as described above, a flow of air from the upper surface toward the lower surface is generated via suction holes of the conveying belt 106. The flow of air causes a flow of air to be generated also in the vicinity of the ejection port to accelerate evaporation of moisture from the ink in the ejection port. In the state where the ejection port faces a print medium, the suction hole is closed up with the print medium and a flow of air from the upper surface of the conveying belt 106 toward the lower surface thereof due to the suction force of the suction fan 107 is not generated. Therefore, evaporation of moisture from the ink in the ejection port is not accelerated.

As described above, the quantity of moisture evaporating from the ink in the ejection port differs between the state in which the ejection port of the print head 110 faces a print medium and the state in which it does not face a print medium. In other words, in the state in which the ejection port faces a print medium, moisture in the ink is hard to evaporate, and in the state in which the ejection port does not face a print medium, moisture in the ink is easy to evaporate.

Therefore, in the present embodiment, the inventor focused on the difference in a quantity of moisture evaporating from the ink in the ejection port. That is, an allowable exposure time period is set in accordance with a time period when the ejection port faces a print medium in a print operation and a time period when the ejection port does not face a print medium, and, if an exposure time period thereof exceeds the allowable exposure time period, the recovery operation (preliminary ejection) is practiced. Hereinafter, a specific method thereof will be explained.

Figure 6:
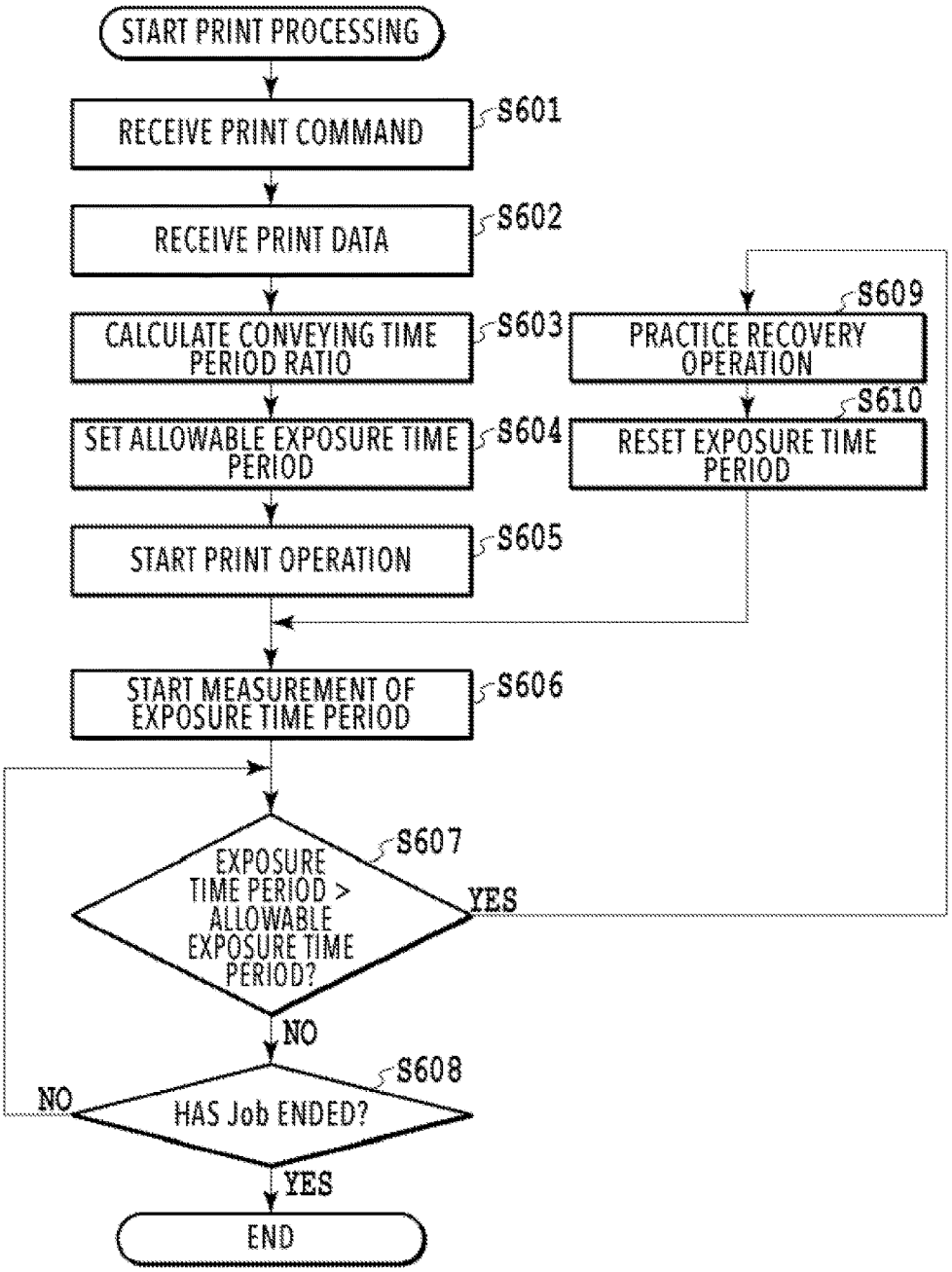
FIG. 6 illustrates a flow chart showing a print processing.

FIG. 6 illustrates a flowchart showing the print processing in the present embodiment. Hereinafter, the print processing of the present embodiment will be explained using the flow chart. When the print processing is started, in Step S601, the CPU 201 of the print apparatus 100 receives a print command from the host 101, and in Step S602, receives print data. After that, in Step S603, from size data of the print medium and conveying speed information thereof in the received print data, the CPU 201 calculates a ratio of a conveying time period of the print medium and a time period between the print medium and subsequent print medium (between print medium). The time period between print medium is calculated from the conveying speed information and an interval between print medium specific to an apparatus. Then, in Step S604, the CPU 201 sets on the basis of the ratio an allowable exposure time period (a time period in which the ejection port is not covered with a capping mechanism) that is a range of exposure time period during which the print head 110 can implement normally ejection of ink droplets, and in Step S605, the print operation is started.

When the print operation is started, in Step S606, the CPU 201 starts measurement of an exposure time period from timing at which the print head 110 and the capping mechanism 402 are separated. After that, in Step S607, the CPU 201 determines whether or not the exposure time period being an elapsed time from the start of exposure time period measurement has exceeded the allowable exposure time period. If it has exceeded the allowable exposure time period, the CPU 201 moves to Step S609 to practice in-cap preliminary ejection, in which ejection of ink droplets is implemented while the print head 110 and the capping mechanism 402 are faced each other, as the recovery operation that discharges an ink whose viscosity has increased due to the exposure. Then, in Step S610, the CPU 201 resets the exposure time period and returns to Step S606. Meanwhile, the recovery operation implemented in Step S609 may be implemented after the end of the print operation for a print medium under print and before the start of the print operation for subsequent one print medium.

If the exposure time period has not exceeded the allowable exposure time period in Step S607, the CPU 201 moves to Step S608 and determines whether or not a print job has ended. If the job is not ended, the CPU 201 returns to Step S607, and if all the print jobs have ended, it ends the print processing.

Figure 7A:
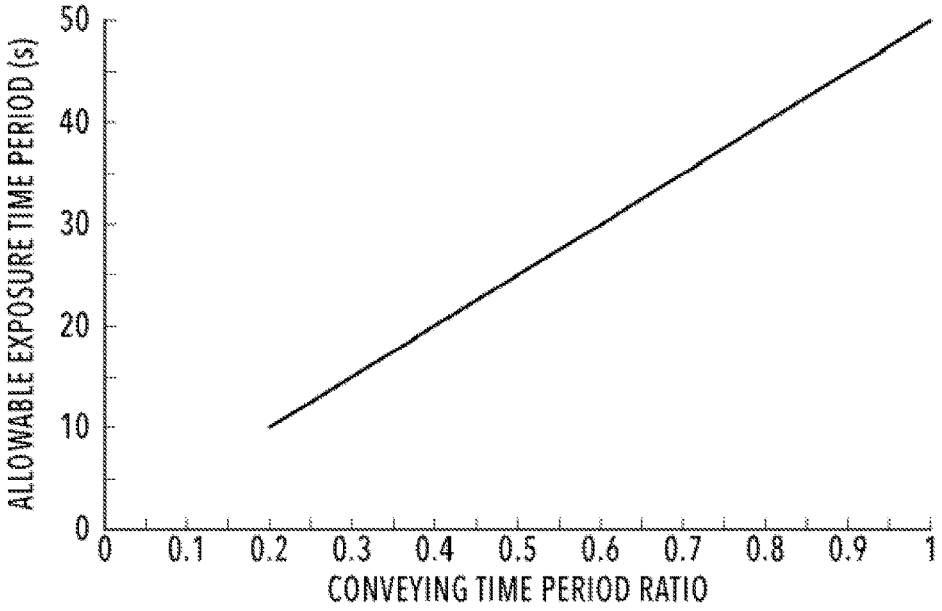
FIG. 7A illustrates a graph showing a relationship between a ratio of facing time period of the print head and a print medium and a not facing time period thereof, and an allowable exposure time period.

FIG. 7A illustrates a graph showing relationship between a facing time period ratio, which is the ratio between a time period in which the print medium faces the ejection port (facing time period) and a time period in which the print medium does not face the ejection port (not facing time period) in the present embodiment, and the allowable exposure time period. The gradient of a line in the graph corresponds to the configuration of the apparatus that influences a dry state of an ink in the ejection port. By using the graph, in Step S604 in FIG. 6, an allowable exposure time period is set from the calculated facing time period ratio.

Meanwhile, in place of the graph, a reference table or a calculation formula may be used to set an allowable exposure time period from a facing time period and a not facing time period.

Here, the allowable exposure time period will be explained with specific examples.

The facing time period is a time period in which a print medium passes a predetermined position facing the ejection port of a print head. The not facing time period is a time period from time when the rear end of a preceding print medium has passed a predetermined position facing the ejection port of a print head until time when the front end of a subsequent print medium arrives at the position facing the ejection port of the same print head. This depends on the interval of print medium to be fed from the feeding tray 103.

Figure 7B:
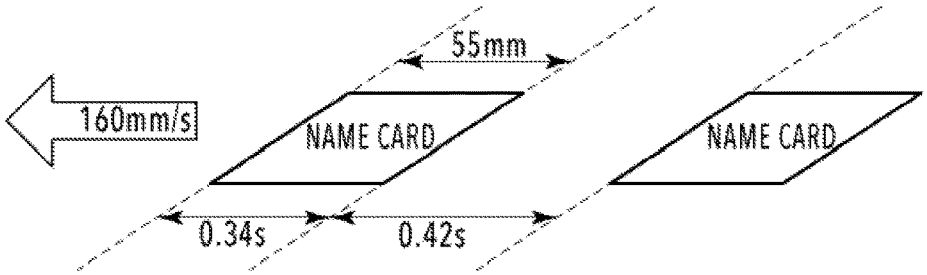
FIG. 7B illustrates a view for explaining the facing time period and not facing time period.

As illustrated in FIG. 7B, in a case where a business card, which is a print medium, with a dimension of 55 mm in a conveying direction is conveyed at a conveying speed of 160 mm/s, the facing time period is 0.34 s and the period between print medium (between business cards), which is the not facing time period, is 0.42 s, on the basis of the feeding interval of the print medium from the feeding tray 103.

Next, the ratio between the facing time period and the not facing time period (facing time period ratio) is calculated to be (0.34 s/0.42 s). With reference to FIG. 7A, in the case where the facing time period ratio is 1 to 1, the allowable exposure time period is 51 s. Accordingly, in the above example, an allowable exposure time period is calculated as follows.

$$\text{Allowable exposure time period(s)}=51\ \text{s}\times(0.34\ \text{s}/0.42\ \text{s})=41\ \text{s}$$

In this way, the allowable exposure time period can be obtained.

Meanwhile, the influence of an evaporation quantity of moisture on ejection performance is different depending on a type of ink to be used in print, such as a dye ink or pigment ink. Therefore, desirably the gradient of the graph is changed in accordance with the type of ink for use in print.

Moreover, the evaporation quantity of moisture in ink varies depending on environmental conditions such as temperature and/or humidity in a print operation. Therefore, preferably, the reference value of allowable exposure time period, in other words the allowable exposure time period in the case where the ratio between the facing time period and the not facing time period is 1 to 1, is set in accordance with the environmental conditions such as temperature and/or humidity in the print operation.

Further, properties of an ink-receiving layer on the surface of a print medium vary depending on the type of the print medium, and therefore a quantity of moisture evaporating from an ink ejected to the print medium varies to result in varied humidity near the ejection port. Therefore, preferably an allowable exposure time period is set in accordance with the type of a print medium.

Furthermore, hardness of a print medium varies depending on the type of the print medium and, therefore, the suction force by the suction fan may be changed in accordance with the hardness thereof. In this case, depending on the type of the print medium, a flow of air in a region in which the print head does not face the print medium varies. Accordingly, preferably the reference value of an allowable exposure time period is set also in consideration of the suction force by the suction fan in accordance with the type of the print medium.

Further, in the present embodiment, the ratio of the time period in which the print medium is conveyed, and the time period between a print medium and subsequent print medium is calculated, from size data and conveying speed information of the print medium in the received print data, but this is not limitative. From detection results of a detector detecting a print medium, a time period in which the print medium is conveyed and a time period between a print medium and subsequent one may be obtained to give the facing time period and not facing time period.

Moreover, in the present embodiment, the case where the preliminary ejection is implemented as the recovery operation has been explained, but the recovery operation is not limited to this. Other operations that recover ejection performance such as wiping that wipes the ejection port or a suction operation sucking ink from the ejection port may also be applied.

Furthermore, even to a case where either the facing time period or the not facing time period changes, the present embodiment can be applied. That is, in a case where the not facing time period is constant, timing of the recovery operation may be set at a moment of the change in size of a print medium, and in a case where the size of a print medium is constant, timing of the recovery operation may be set at a moment of the change in the not facing time period.

The size of a print medium may be changed by a user, and the not facing time period may change depending on setting change by a user and/or waiting time in a case where temperature of the print head 110 has been raised.

As explained above, by setting timing for practicing the recovery operation, an inkjet print apparatus and a recovery method of an inkjet print apparatus that can suppress deterioration of productivity can have been actualized.

Second Embodiment

Hereinafter, a second embodiment of the present invention will be explained with reference to the drawings. Meanwhile, basic configurations of the present embodiment are the same as those of the first embodiment, and therefore only characteristic configurations will be explained below.

In the present embodiment, an example will be explained, in which the CPU 201 changes recovery timing in a case where the interval between a preceding print medium and a subsequent print medium has been changed by user's setting.

Figures 8A, 8B:
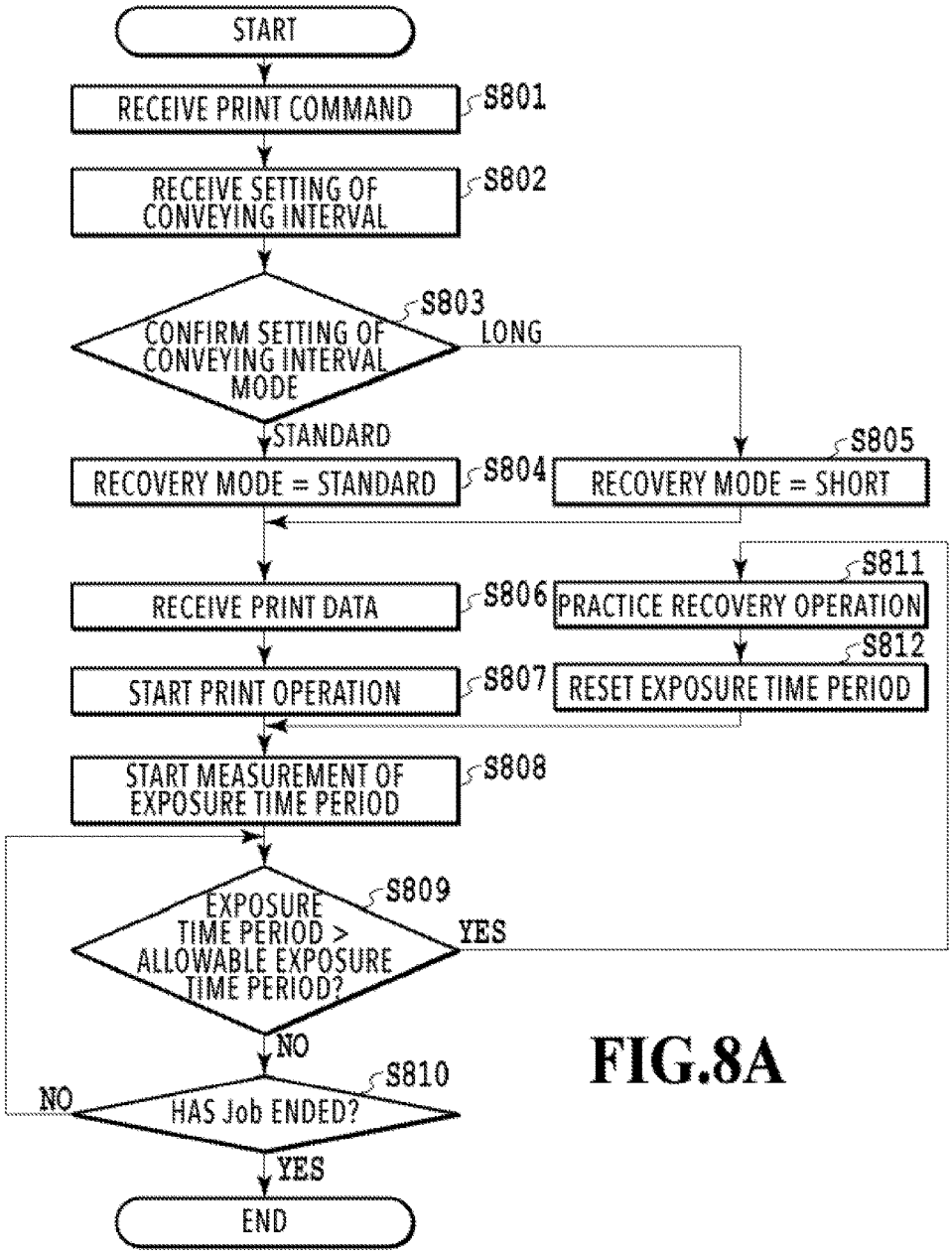
FIG. 8A illustrates a flow chart showing the print processing.
FIG. 8B illustrates a table showing a relationship between a conveying interval and a recovery mode.

FIG. 8A illustrates a flow chart showing print processing in the present embodiment. The basic control flow is the same as that of the flowchart in FIG. 6, and therefore different parts will be explained.

In Step S802, the CPU 201 receives setting of a conveying interval mode from the host 101. The setting is set by a user on the host 101 about the interval between a preceding print medium and a subsequent one of continuously conveyed print medium.

Next, the CPU 201 implements setting of the recovery mode in Step S803. The CPU 201 confirms the contents of setting of the conveying interval mode received in Step S802, and sets the interval between recovery operations, in other words, the allowable exposure time period. Specifically, as shown in FIG. 8B, setting of two modes, "standard" or "long," is made possible about the conveying interval between print medium. The CPU 201 sets the allowable exposure time period to "standard" (for example, 50 seconds) that is a predetermined value in a case where the conveying interval mode of the print medium is "standard" (Step S804). Further, in a case where the setting of the conveying interval mode is "long, " the CPU 201 sets the allowable exposure time period to one shorter than in "standard" (for example, 40 seconds) (Step S805).

Here, an allowable exposure time period corresponding to "standard" or "short" of the recovery mode is suitably set in accordance with the type of ink and/or configuration of apparatus to be used.

After that, the CPU 201 implements a print operation on the basis of received print data, and executes the recovery operation in accordance with the set allowable exposure time period.

Meanwhile, in the present embodiment, the setting of the conveying interval mode of a print medium is explained so that the selection is done from two, that is, "standard" and "long," but the selection may be done from three or more. On this occasion, the allowable exposure time period may be set shorter than that in a case where the conveying interval of a print medium is longer.

Moreover, in the present embodiment, a case where a user sets the conveying interval of print medium has been explained, but it is also possible that the CPU 201 alters the recovery operation mode in accordance with the change of conveying time period of the print medium due to another factor such as temperature rise of the print head 110 in a print operation.

Third Embodiment

Hereinafter, a third embodiment of the present invention will be explained with reference to the drawings. Meanwhile, basic configurations of the present embodiment are the same as those of the first embodiment, and therefore only characteristic configurations will be explained below.

As a type of preliminary ejection, there is a preliminary ejection onto a sheet, in which ink is ejected within an image formation region on a print medium so that the ink is hardly recognized visually. The preliminary ejection onto a sheet is implemented so that ink droplets not included in print data are ejected so as to be hardly recognized visually to the inside of an image formation region or outside of an image formation region on the print medium, in order to reduce increase in viscosity of an ink in the ejection port. In the case where a preliminary ejection onto a sheet is implemented, a shorter ejection interval of the preliminary ejection onto a sheet results in a higher effect of reducing increase in viscosity of an ink inside the ejection port. Accordingly, in the present embodiment, attention is payed to this point and timing of implementing exposure recovery is set, in a print operation accompanied with the preliminary ejection onto a sheet, on the basis of the ejection interval in the preliminary ejection onto a sheet, and the facing time period and not facing time period of the print head and the print medium.

Meanwhile, in the present embodiment, a level of the preliminary ejection onto a sheet may be selected from three stages and an ejection interval in the preliminary ejection onto a sheet in each of ejection ports will be shorter as the level becomes higher. As the level of the preliminary ejection onto a sheet becomes higher, the effect on reducing increase in viscosity of an ink inside the ejection port becomes higher and humidity near the print head rises due to the moisture evaporated from ink droplets ejected onto the print medium, and therefore the allowable exposure time period can be set to be longer. Consequently, a coefficient to be multiplied to an allowable exposure time period is set larger as the level of the preliminary ejection onto a sheet becomes higher. Hereinafter, a specific method thereof will be explained.

Figures 9A, 9B:
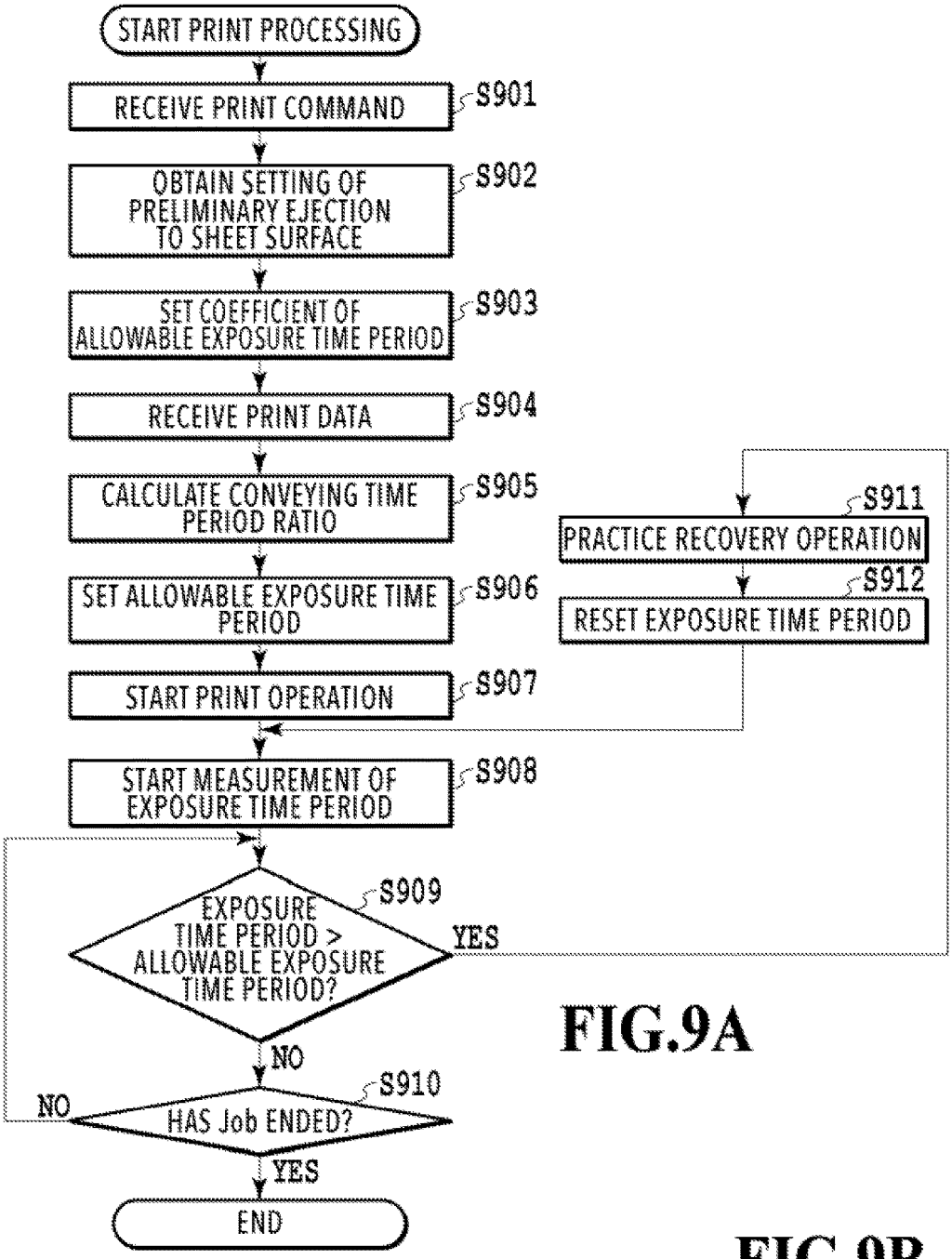
FIG. 9A illustrates a flow chart showing the print processing.
FIG. 9B illustrates a table showing levels of preliminary ejection onto a sheet surface and respective coefficients thereof.

FIG. 9A illustrates a flow chart showing the print processing in the present embodiment, and FIG. 9B illustrates a table showing levels of preliminary ejection onto a sheet and coefficients thereof. Hereinafter, the print processing of the present embodiment will be explained using the flow chart in FIG. 9A and the table in FIG. 9B. Meanwhile, explanation of processing that is the same as that of the first embodiment (in the flow chart in FIG. 6) will be omitted. The print processing in the present embodiment differs from the print processing of the first embodiment in Steps S902, S903 and S906. The CPU 201 receives a print command in Step S901, and then, in Step S902, obtains the level of preliminary ejection onto a sheet for setting the preliminary ejection onto a sheet. After that, in Step S903, the CPU 201 sets an allowable exposure time period coefficient from the obtained level of preliminary ejection onto a sheet on the basis of the table in FIG. 9B. Then, in Step S906, the CPU 201 identifies an allowable exposure time period from the conveying time period ratio, and sets a value obtained by multiplying the specified allowable exposure time period by the allowable exposure time period coefficient set in Step S903 as the allowable exposure time period.

As described above, the CPU 201 sets timing for practicing the recovery operation in accordance with the facing time period and not facing time period between the print unit and the print medium and the level of preliminary ejection onto a sheet. Consequently, an inkjet print apparatus and a recovery method of an inkjet print apparatus that can further suppress deterioration of productivity can have been actualized.

Other Embodiments

Hereinafter, other embodiments of the present invention will be explained with reference to the drawings. Meanwhile, basic configurations of the present embodiments are the same as those of the first embodiment, and therefore only characteristic configurations will be explained below.

The preliminary ejection onto a sheet can be practiced in a state where the ejection port faces a print medium, in other words, cannot be practiced in a state where the ejection port does not face a print medium. Accordingly, in a case where the conveying unit 104 conveys the print medium P in FIG. 3, the evaporation quantity of moisture from an ink in the ejection port varies depending on the level of preliminary ejection onto a sheet surface, in a state where the ejection port of the print head 110 faces the print medium P from that in a state where it does not face the print medium P.

From this, the conveying unit 104 as a conveying unit may convey sheet-fed print medium, and is not necessarily specified to a configuration in which print medium are attached to the conveying belt 106 by the suction fan 107 to be conveyed.

In addition, embodiments are also applicable to an aspect in which a plurality of labels being print medium is stuck to a continuous sheet (separator). In this case, timing for practicing the recovery operation is set on the basis of a time period during which the print head faces the label and a time period during which the print head does not face the label (a time period during which the print head faces the separator).

while the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Applications No. 2017-033686, filed Feb. 24, 2017 and No. 2018-022186, filed Feb. 9, 2018, which are hereby incorporated by reference wherein in their entirety.

What is claimed is:

1. An inkjet print apparatus comprising:

a print unit configured to eject ink to a print medium to implement print;

a recovery unit configured to practice recovery processing to recover an ejection performance for ink of the print unit; and setting unit configured to set timing at which the recovery unit practices the recovery processing on a basis of a facing time period during which the print unit faces a print medium in a print operation and a not facing time period during which the print unit does not face the print medium in the print operation.

2. The inkjet print apparatus according to claim 1, further comprising a conveying unit for conveying a print medium while sucking the print medium by negative pressure generated by a negative pressure generator, wherein the setting unit obtains the facing time period on a basis of conveying speed of the conveying unit and a dimension of the print medium in a conveying direction.

3. The inkjet print apparatus according to claim 1, further comprising a detector for detecting presence/absence of a print medium, wherein the setting unit obtains the facing time period on a basis of a detection result of the detector.

4. The inkjet print apparatus according to claim 1, wherein the recovery processing practiced by the recovery unit is preliminary ejection in which the print unit ejects ink not contributing to print.

5. The inkjet print apparatus according to claim 1, wherein the setting unit sets timing at which the recovery unit practices the recovery processing on a basis of a type of ink to be used in print.

6. The inkjet print apparatus according to claim 1, wherein the setting unit sets timing at which the recovery unit practices the recovery processing on a basis of environmental conditions in a print operation.

7. The inkjet print apparatus according to claim 1, wherein the setting unit sets timing at which the recovery unit practices the recovery processing on a basis of a type of a print medium to be printed.

8. The inkjet print apparatus according to claim 1, further comprising a capping unit configured to cap the print unit, wherein the setting unit sets timing at which the recovery unit practices the recovery processing on a basis of the facing time period and the not facing time period in a state where the capping unit does not cap the print unit.

9. A recovery method of an inkjet print apparatus, comprising:

a print step in which a print unit ejects ink to a print medium;

a recovery step practicing recovery processing to recover an ejection performance for ink of the print unit; and a setting step setting timing at which the recovery processing is practiced on a basis of a facing time period during which the print unit faces a print medium and a not facing time period during which the print unit does not face a print medium in the print step.

10. An inkjet print apparatus comprising:

a print unit configured to eject ink to a print medium to implement print;

a conveying unit configured to convey the print medium;

a recovery unit configured to practice recovery processing to recover an ejection performance for ink of the print unit; and a setting unit configured to set timing at which the recovery processing is practiced, wherein the setting unit is capable of selecting one mode from a plurality of modes including a first mode in which an interval from a rear end in a conveying direction of a preceding print medium to a front end in a conveying direction of a subsequent print medium is set as a first interval and a second mode in which an interval different from the first interval is set as a second interval, and that causes timing at which the recovery processing is practiced to be varied between the first mode and the second mode, in a case where print is implemented continuously at a predetermined conveying speed for a plurality of print medium with a predetermined size conveyed by the conveying unit.

11. The inkjet print apparatus according to claim 10, wherein the setting unit sets the timing at which the recovery unit practices the recovery processing in the second mode earlier than the timing at which the recovery unit practices the recovery processing in the first mode, in a case where the second interval is broader than the first interval.

12. The inkjet print apparatus according to claim 10, wherein the conveying unit conveys a print medium while sucking the print medium by negative pressure generated by a negative pressure generator.

13. The inkjet print apparatus according to claim 12, wherein the setting unit sets timing at which the recovery unit practices the recovery processing on a basis of magnitude of negative pressure generated by the negative pressure generator.

14. A recovery method of an inkjet print apparatus, comprising:

a print step in which a print unit ejects ink to a print medium;

a recovery step practicing recovery processing to recover an ejection performance for ink of the print unit; and a setting step setting a first timing at which the recovery processing is practiced for a first mode including an interval from a rear end in a conveying direction of a preceding print medium to a front end in a conveying direction of a subsequent print medium as a first interval and a second timing different from the first timing for a second mode including an interval different from the first interval as a second interval.

* * * * *